US011959487B2

(12) United States Patent
Kosmicki

(10) Patent No.: US 11,959,487 B2
(45) Date of Patent: Apr. 16, 2024

(54) CENTRIFUGAL SLURRY PUMP IMPELLER

(71) Applicant: Weir Slurry Group, Inc., Madison, WI (US)

(72) Inventor: Randy James Kosmicki, Edgerton, WI (US)

(73) Assignee: Weir Slurry Group, Inc., Madison, WI (US)

( * ) Notice: Subject to any disclaimer, the term of this patent is extended or adjusted under 35 U.S.C. 154(b) by 0 days.

(21) Appl. No.: 18/025,269

(22) PCT Filed: Sep. 30, 2021

(86) PCT No.: PCT/AU2021/051139
§ 371 (c)(1),
(2) Date: Mar. 8, 2023

(87) PCT Pub. No.: WO2022/067385
PCT Pub. Date: Apr. 7, 2022

(65) Prior Publication Data

US 2023/0323889 A1 Oct. 12, 2023

Related U.S. Application Data

(60) Provisional application No. 63/085,353, filed on Sep. 30, 2020.

(30) Foreign Application Priority Data

Oct. 22, 2020 (AU) ..... 2020903823

(51) Int. Cl.
*F04D 29/22* (2006.01)
*F04D 7/04* (2006.01)

(52) U.S. Cl.
CPC ..... *F04D 29/2216* (2013.01); *F04D 7/04* (2013.01)

(58) Field of Classification Search
CPC ... F04D 7/04; F04D 7/02; F04D 29/22; F04D 29/2216
See application file for complete search history.

(56) References Cited

U.S. PATENT DOCUMENTS 2,625,884 A * 1/1953 Welsh ..... F04D 29/2294 416/241 A
4,759,690 A * 7/1988 Deschamps ..... F04D 29/2294 416/213 A (Continued)

*Primary Examiner* — Woody A Lee, Jr.
*Assistant Examiner* — Joshua R Beebe
(74) *Attorney, Agent, or Firm* — Morriss O'Bryant; Compagni Cannon, PLLC.

(57) ABSTRACT

A centrifugal slurry pump impeller including a back shroud and a front shroud each with opposed inner and outer faces and an outer peripheral edge and a central axis, a plurality of pumping vanes extending between the inner main faces of the back and front shroud, each pumping vane including opposed main side faces, a leading edge in the region of the central axis and a trailing edge in the region of the outer peripheral edges of the back and front shrouds with a passageway between adjacent pumping vanes, each passageway including a blended region between each of the main side faces of the pumping vanes and the inner faces of the front and back shrouds wherein a surface of the inner face of at least one of the front and back shrouds includes a raised portion located between the blended regions of adjacent pumping vanes.

18 Claims, 15 Drawing Sheets

(56) References Cited

U.S. PATENT DOCUMENTS

| | | | | |
|---|---|---|---|---|
| 5,192,193 | A * | 3/1993 | Cooper | F04D 29/242 416/186 R |
| 5,478,200 | A * | 12/1995 | Brodersen | F04D 29/242 415/206 |
| 10,648,480 | B2 * | 5/2020 | Echeverri | F04D 29/2294 |
| 2015/0377246 | A1 * | 12/2015 | Tieu | F04D 29/2266 416/189 |
| 2019/0120244 | A1 | 4/2019 | Shoji | |

* cited by examiner

CENTRIFUGAL SLURRY PUMP IMPELLER

TECHNICAL FIELD

This disclosure relates in general to a slurry pump impeller for use in centrifugal pumps and more particularly though not exclusively to pumps for handling abrasive materials such as for example slurries and the like.

Various process steps in the minerals processing industry involve erosive contact with components of equipment which results in significant wear to the extent that frequent replacement is required. However, often the wear of a component is uneven depending on the nature of the process step.

For example, in the process of pumping abrasive slurries using a centrifugal slurry pump, a limiting factor on the centrifugal slurry pump wet end component wear life can be localised wear in the form of deep gouging or very high wear rates in certain locations of the slurry pump impeller even though other parts of the impeller may be wearing at a relatively low rate.

The high wear at the impeller front and back shroud relates to the velocity and degree of turbulence in the flow in these regions. The present disclosure seeks to provide a centrifugal pump impeller which results in decreased wear in these regions.

The various aspects disclosed herein may be applicable to all centrifugal slurry pumps and particularly to those that experience high wear rates at the impeller shrouds.

SUMMARY

According to one aspect there is provided a centrifugal slurry pump impeller including a back shroud and a front shroud each with opposed inner and outer faces and an outer peripheral edge and a central axis, the front shroud including an impeller inlet and the back shroud including an impeller nose raised from the inner face of the back shroud facing the impeller inlet and in line with the central axis, a plurality of pumping vanes extending between the inner main faces of the back and front shroud, the pumping vanes being disposed in spaced apart relation, each pumping vane including opposed main side faces, a leading edge in the region of the central axis and a trailing edge in the region of the outer peripheral edges of the back and front shrouds with a passageway between adjacent pumping vanes, each passageway including a blended region between each of the main side faces of the pumping vanes and the inner faces of the front and back shrouds wherein a surface of the inner face of at least one of the front and back shrouds includes a raised portion located between the blended regions of adjacent pumping vanes.

In certain embodiments, each passageway extends from an inner region of the passageway beginning adjacent the leading edge of the plurality of pumping vanes to an outer region of the passageway wherein the outer region ends at the outer peripheral edge of the front and back shrouds and wherein the raised portion is located in the inner region of the passageway.

In certain embodiments, the raised portion extends from the inner region adjacent the leading edge of the plurality of pumping vanes and ends about three quarters along the length of the passageway. In another form, the raised portion ends about midway along the length of the passageway from the region adjacent the leading edge of the plurality of pumping vanes.

In certain embodiments, the inner surfaces of the front and back shroud in the outer region are substantially planar and are in a plane that is substantially perpendicular to the central axis.

In certain embodiments, one of the opposed side faces of the adjacent pumping vanes is a pressure side face and the other of the opposed side faces is a suction side face wherein an apex of the raised portion is located closer to the suction side face than the pressure side face.

In certain embodiments, the raised portion includes a convex surface.

In certain embodiments, the distance between the inner faces of the back and front shroud is greater in the outer region than the inner region of the passageway.

In certain embodiments, the raised portion provides a surface on the inner face of the back and/or front shroud which continues from the blended region associated with one of the opposed side faces to the blended region of the other of the opposed side faces of the adjacent pumping vanes.

In certain embodiments, the apex of the raised portion is located adjacent the suction side face to which it is closest so as to modify the flow of slurry through the passageway in use and thereby reduce turbulence and/or inhibit the formation of vortices formed adjacent the inner main face of the back and/or front shroud.

In certain embodiments, the raised portion is located on the inner face of the front shroud.

In certain embodiments, the raised portion is located on the inner face of the back shroud.

In certain embodiments, the raised portion is located in each one of the passageways located between adjacent pumping vanes.

In certain embodiments, the apex of the raised portion is spaced from the blended region located between the main side faces of the pumping vanes and the inner face of the back and/or front shroud.

In certain embodiments, the pumping vanes are backwardly swept in shape. In one form the impeller has no more than six pumping vanes. In a further form, the impeller has four pumping vanes.

According to another aspect there is provided a centrifugal slurry pump impeller including a back shroud with an inner and outer face and an outer peripheral edge and a central axis, the back shroud including an impeller nose raised from the inner face in line with the central axis, a plurality of pumping vanes extending between the inner main face of the back shroud, the pumping vanes being disposed in spaced apart relation, each pumping vane including opposed main side faces, a leading edge in the region of the central axis and a trailing edge in the region of the outer peripheral edge of the back shroud with a passageway between adjacent pumping vanes, each passageway including a blended region between each of the main side faces of the pumping vanes and the inner face of the back shrouds wherein a surface of the inner face of the back shroud includes a raised portion located between the blended regions of adjacent pumping vanes.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

FIG. 16 is a sectional isometric view of the prior art impeller depicted in FIGS. 14 and 15;

FIG. 17 is a schematic sectional view of a prior art impeller depicting contour lines on the back shroud;

FIG. 18 is a sectional rendered view of the prior art impeller depicted in FIG. 17;

FIG. 19 is a sectional isometric view of the prior art impeller depicted in FIG. 17 and FIG. 18; and, FIG. 20 is a cross-sectional rendered view of the prior art impeller depicted in FIGS. 14 to 19

DETAILED DESCRIPTION

Figure 1:
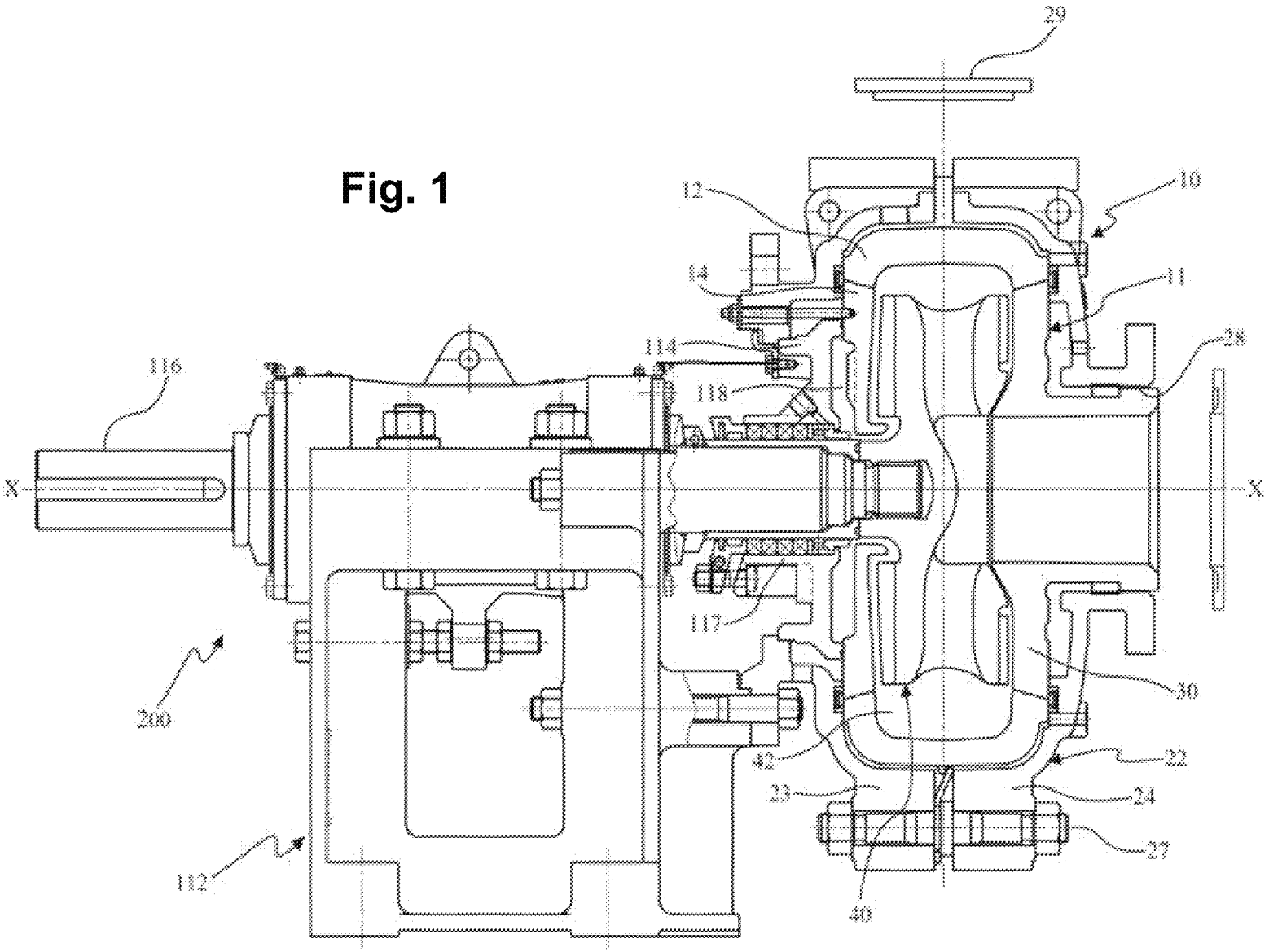
FIG. 1 is a schematic partial cross-sectional side elevation of one form of a pump apparatus according to one embodiment.

Referring to FIG. 1 of the drawings, there is generally illustrated a pump apparatus 200 comprising a pump 10 and pump housing support in the form of a pedestal or base 112 to which the pump 10 is mounted. Pedestals are also referred to in the pump industry as frames. The pump 10 generally comprises an outer casing 22 that is formed from two side casing parts or sections 23, 24 (sometimes also known as the frame plate and the cover plate) which are joined together about the periphery of the two side casing sections 23, 24. The pump 10 is formed with side openings one of which is an inlet 28 there further being a discharge outlet 29 and, when in use in a process plant, the pump is connected by piping to the inlet 28 and to the outlet 29, for example to facilitate pumping of a mineral slurry.

The pump 10 further comprises a pump inner liner 11 arranged within the outer casing 22 and which includes a main liner 12 and two side liners 14, 30. The side liner 14 is located nearer the rear end of the pump 10 (that is, nearest to the pedestal or base 112), and the other side liner (or front liner) 30 is located nearer the front end of the pump and inlet hole 28. The side liner 14 is also referred to as the back side part or frame plate liner insert and the side liner 30 is also referred to as the front side part or throatbrush. The main liner 12 comprises two side openings therein.

The two side casing parts 23, 24 of the outer casing 22 are joined together by bolts 27 located about the periphery of the casing parts 23, 24 when the pump is assembled for use. In some embodiments the main liner 12 can also be comprised of two separate parts which are assembled within each of the side casing parts 23, 24 and brought together to form a single main liner, although in the example shown in FIG. 1 the main liner 12 is made in one-piece, shaped similar to a car tyre. The liner 11 may be made of materials such as rubber, elastomer or of metal.

When the pump is assembled, the side openings in the main liner 12 are filled by or receive the two side liners 14, 30 to form a continuously-lined pumping chamber 42 disposed within the pump outer casing 22. A seal chamber housing 114 encloses the side liner (or back side part) 14 and is arranged to seal the space or chamber 118 between drive shaft 116 and the pedestal or base 112 to prevent leakage from the back area of the outer casing 22. The seal chamber housing takes the form of a circular disc section and an annular section with a central bore, and is known in one arrangement as a stuffing box 117. The stuffing box 117 is arranged adjacent to the side liner 14 and extends between the pedestal 112 and a shaft sleeve and packing that surrounds drive shaft 116.

Figure 2:
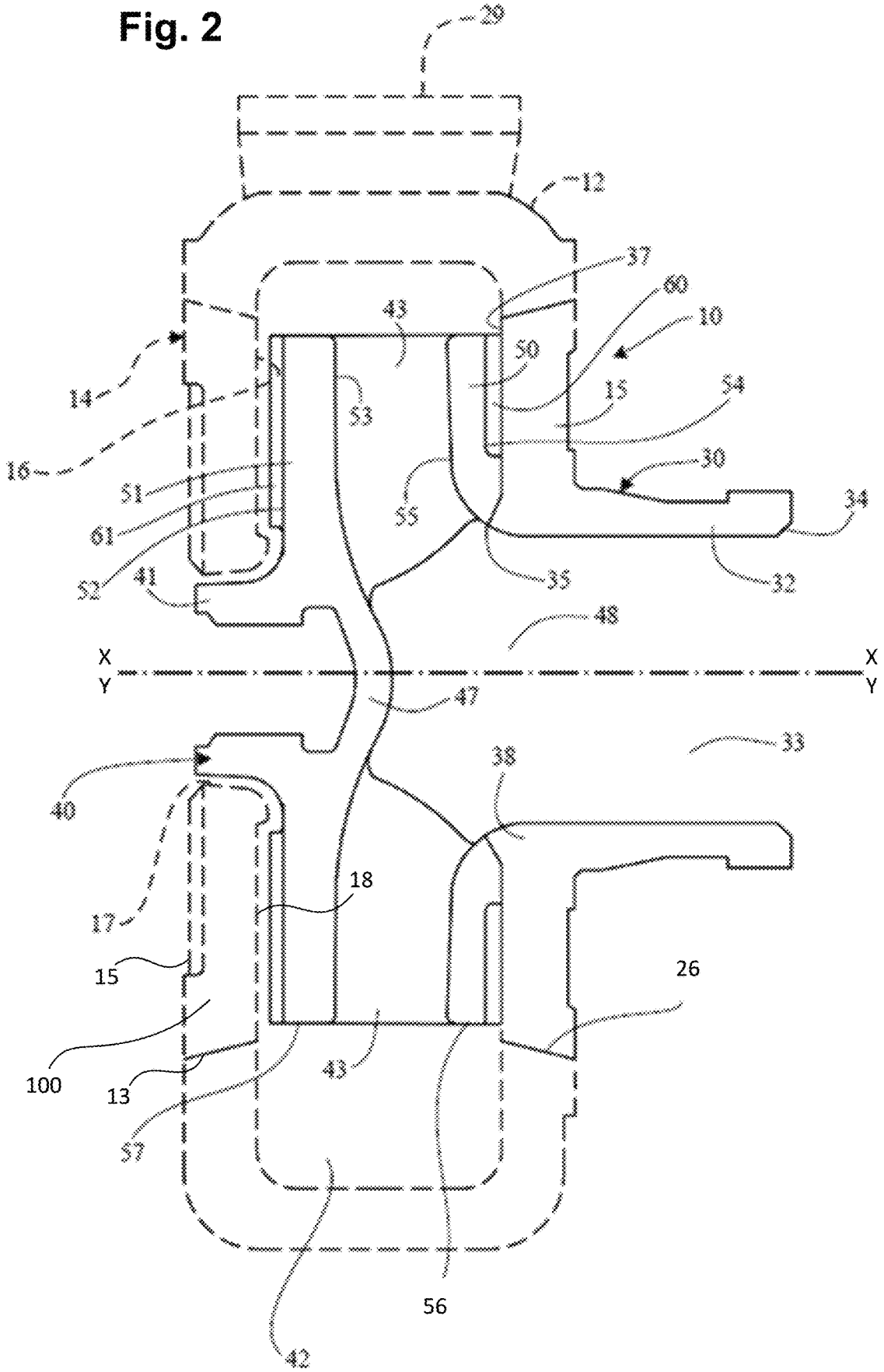
FIG. 2 is a more detailed schematic partial cross-sectional side elevation of part of the pump apparatus of FIG. 1.

As shown in FIGS. 1 and 2 an impeller 40 is positioned within the main liner 12 and is mounted or operatively connected to the drive shaft 116 which is adapted to rotate about a rotation axis X-X, or central axis. A motor drive (not shown) is normally attached by pulleys to an exposed end of the shaft 116, in the region behind the pedestal or base 112. The rotation of the impeller 40 causes the fluid (or solid-liquid mixture) being pumped to pass from a pipe which is connected to the inlet 28 through the pumping chamber 42 which is within the main liner 12 and the side liners 14, 30 and then out of the pump via the discharge outlet 29.

The impeller 40 includes a hub 41 from which a plurality of circumferentially spaced pumping vanes 43 extend. A nose portion 47 extends forwardly from the hub 41 along the rotation axis towards an impeller inlet 48 and an inlet passage 33 in the front liner 30. The impeller 40 further includes a front shroud 50 and a back shroud 51, the vanes 43 being disposed and extending therebetween. In an alternate embodiment, the impeller may be of a semi-open configuration with a back shroud but no front shroud with applications in pumping froth and/or use in vertical pumps.

The impeller front shroud 50 includes an inner face 55, an outer face 54 and a peripheral edge portion 56. The back shroud 51 includes an inner face 53, an outer face 52 and a peripheral edge portion 57. The front shroud 50 includes the inlet 48, being the impeller inlet and the vanes 43 extend between the inner faces of the shrouds 50, 51. The nose portion 47 extends in the form of a rounded surface from the inner face 53 of the back shroud 51 facing the inlet in line with the rotation axis X-X. The shrouds are generally circular or disc-shaped when viewed in elevation; that is in the direction of rotation axis X-X.

As illustrated in FIG. 2, each impeller shroud may have a plurality of auxiliary or expelling vanes on the outer faces 52, 54 thereof, there being a first group of auxiliary vanes 60 on the outer face 54 of the front shroud 50 and a second group of auxiliary vanes 61 on the outer face 52 of the back shroud 51. Auxiliary vanes are an optional feature of the impeller.

Figure 3:
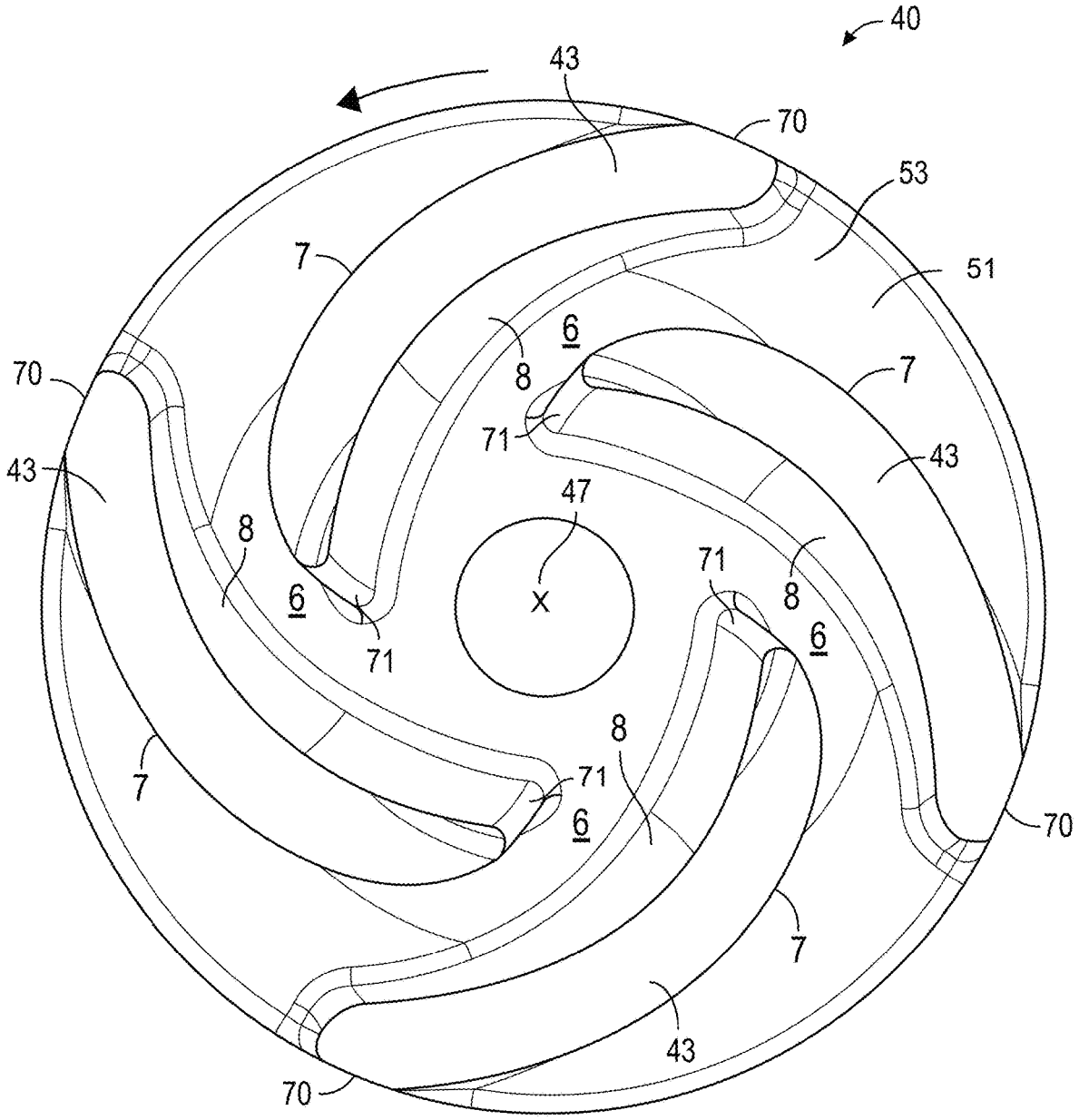
Fig. 3 Prior Art
FIG. 3 is a section view of a prior art impeller depicting the back shroud in plan view.
Figure 4:
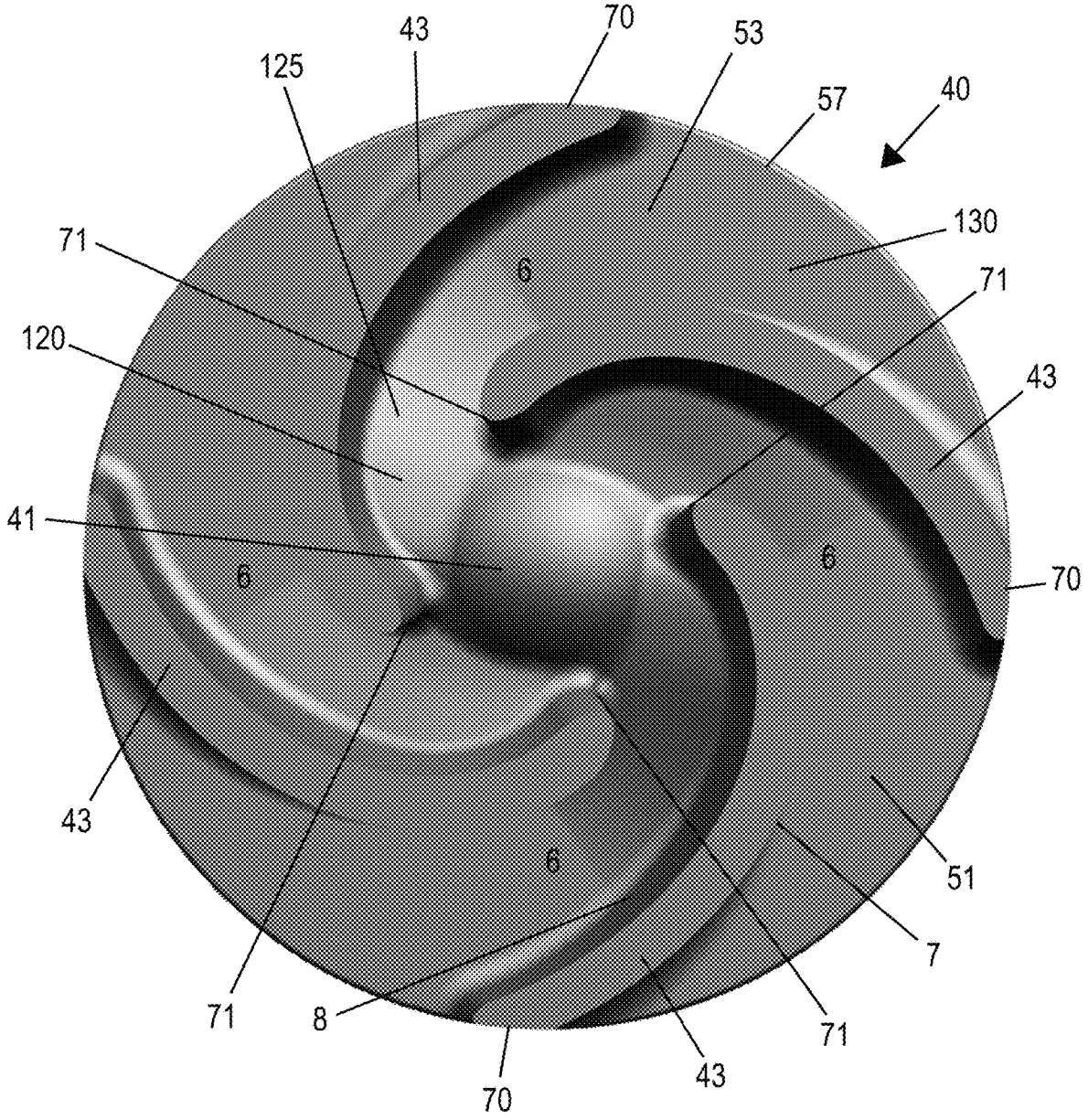
FIG. 4 is a sectional rendered view of an impeller depicting the back shroud in accordance with an embodiment of the present disclosure.
Figure 5:
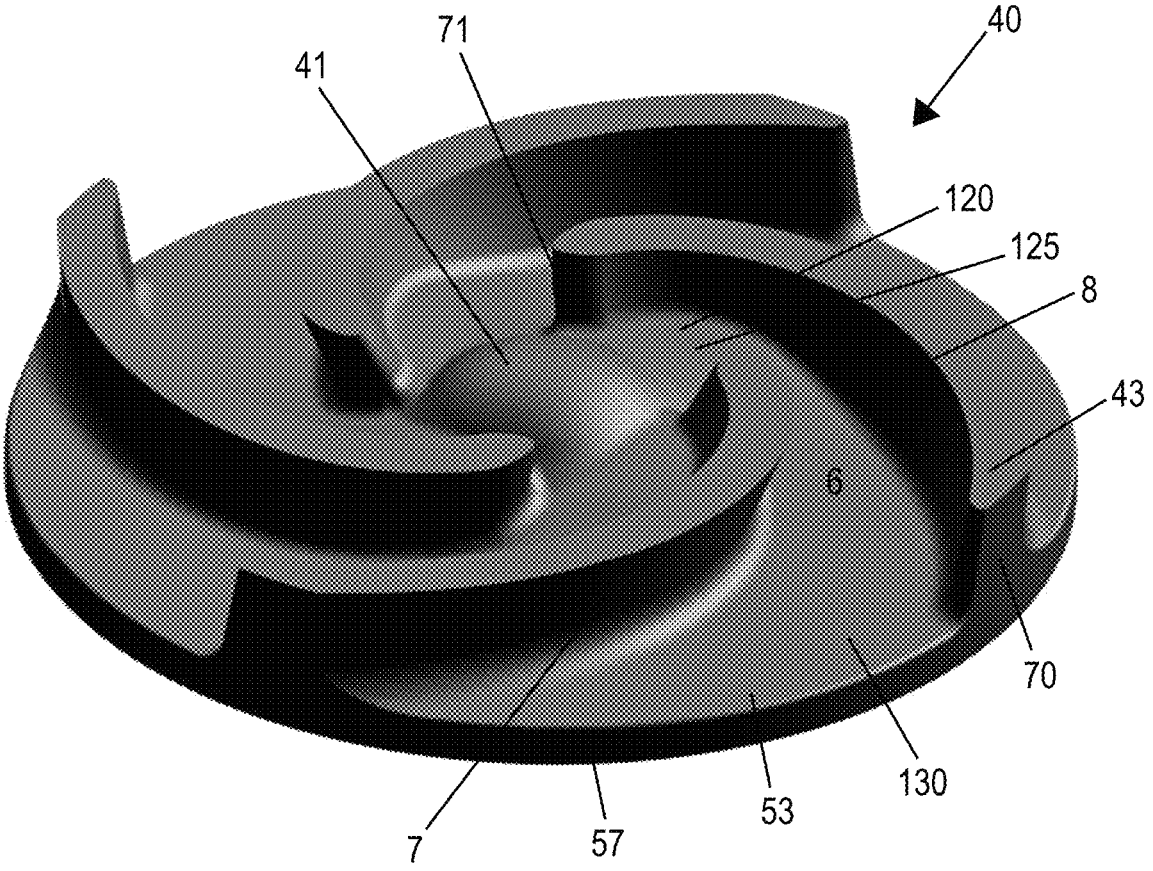
FIG. 5 is an isometric rendered sectional view of the impeller of FIG. 4.
Figure 6:
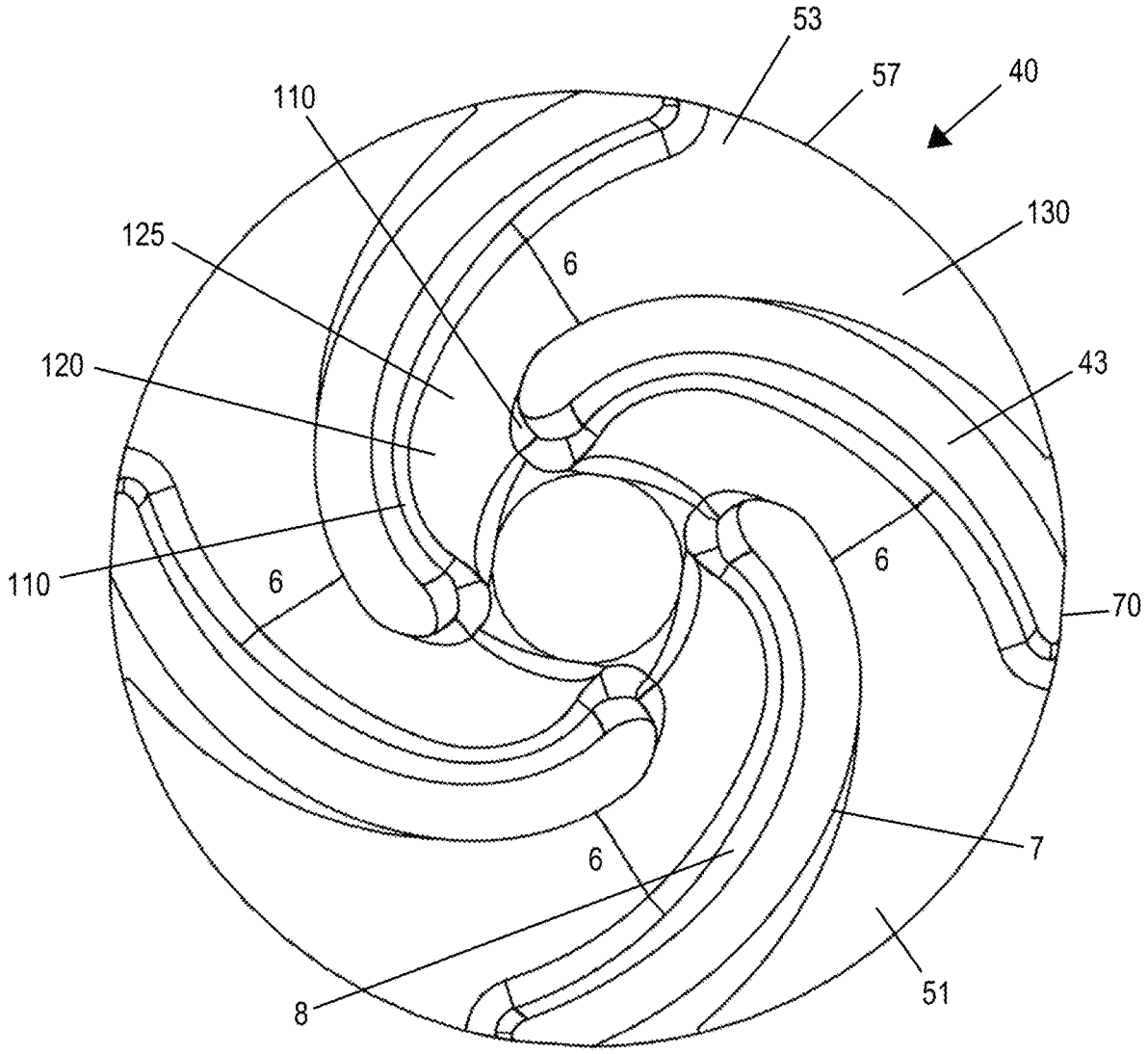
FIG. 6 is a schematic sectional view of the impeller of FIG. 4.
Figure 7:
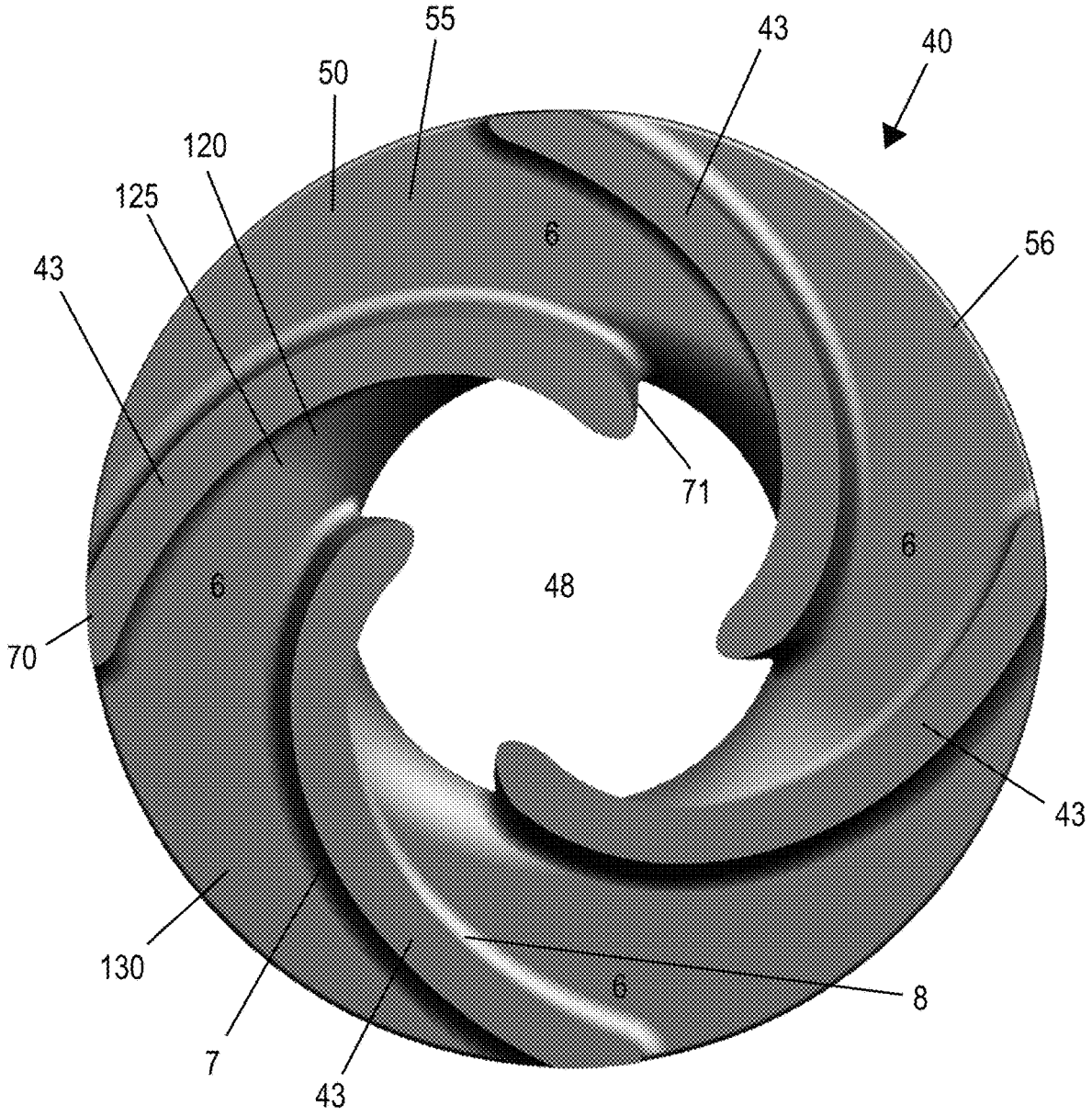
FIG. 7 is a sectional rendered view of an impeller depicting the front shroud in accordance with an embodiment of the present disclosure.
Figure 8:
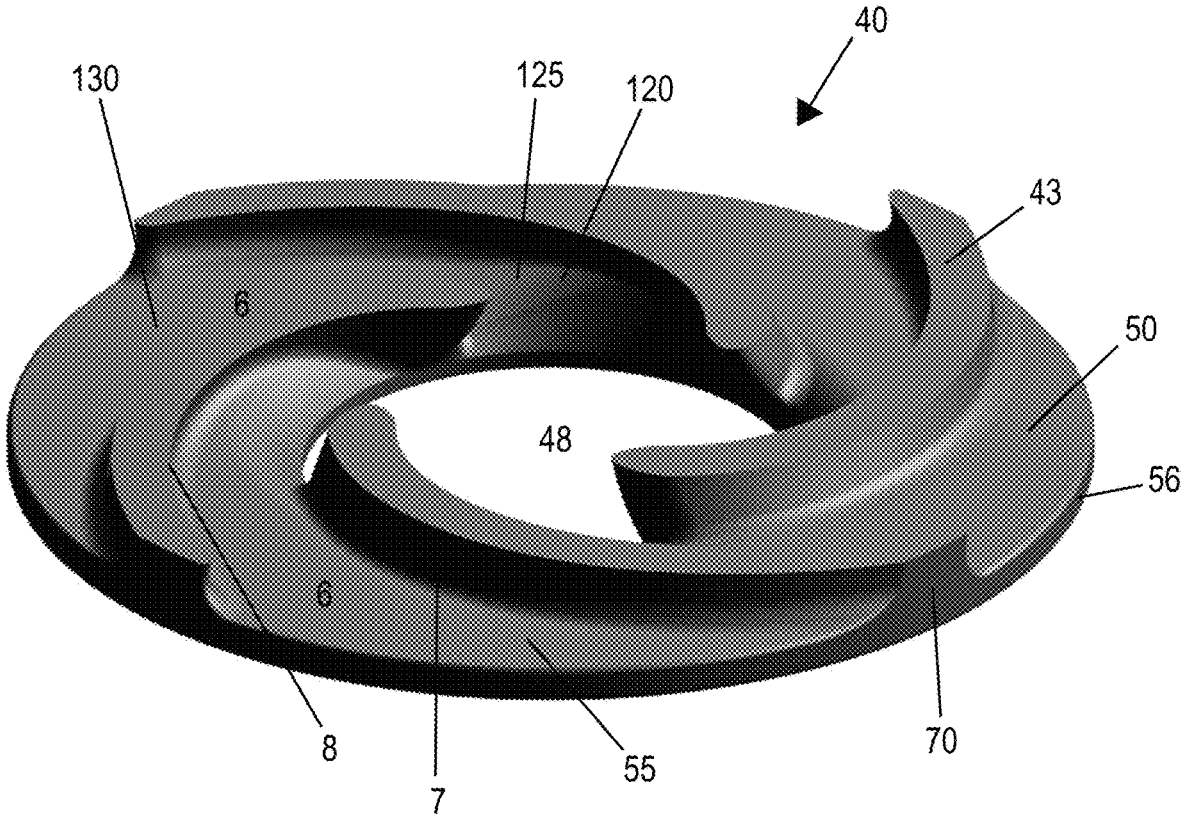
FIG. 8 is an isometric rendered section view of the impeller of FIG. 7.
Figure 9:
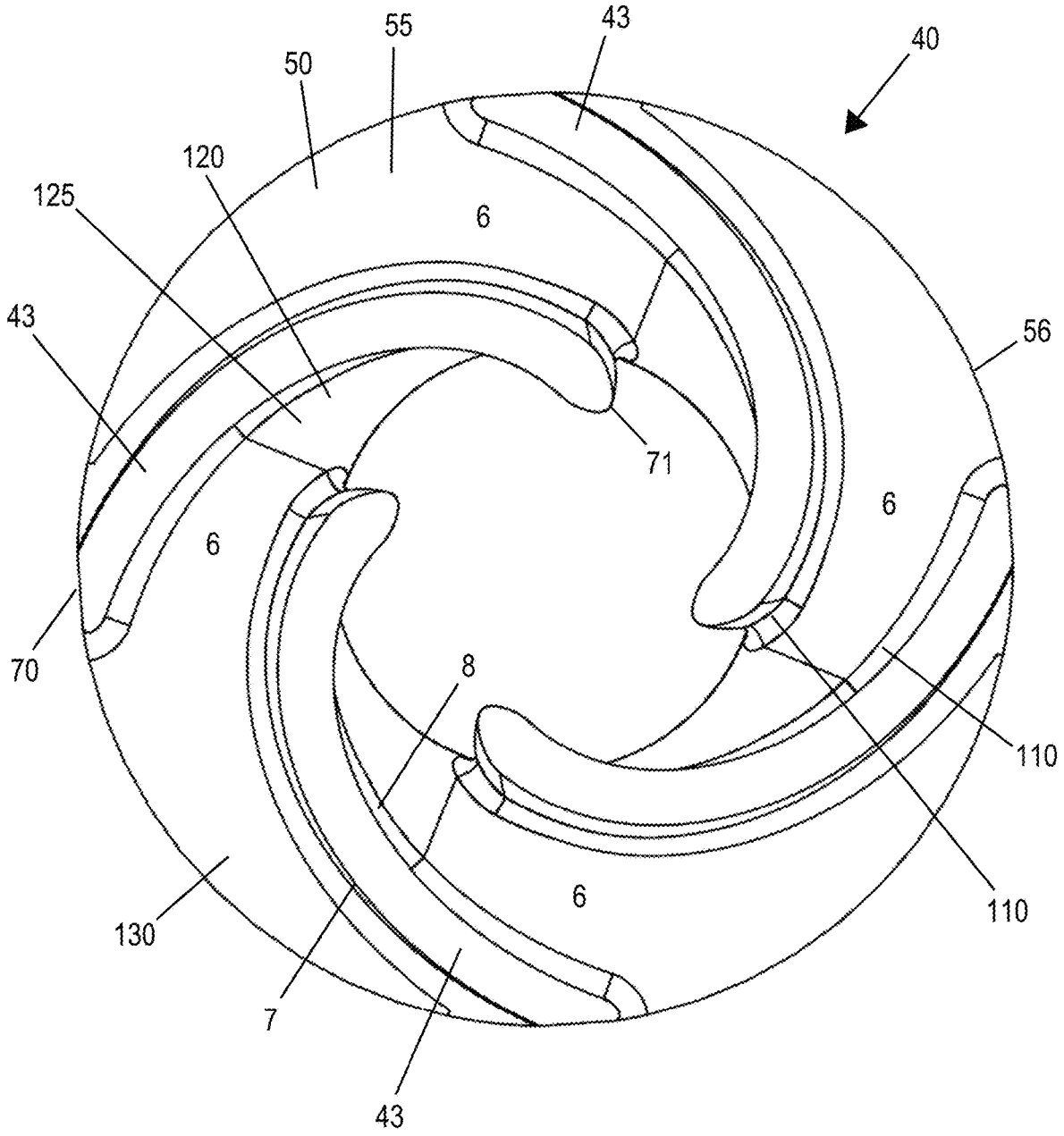
FIG. 9 is a schematic section view of the impeller of FIG. 7.
Figure 10:
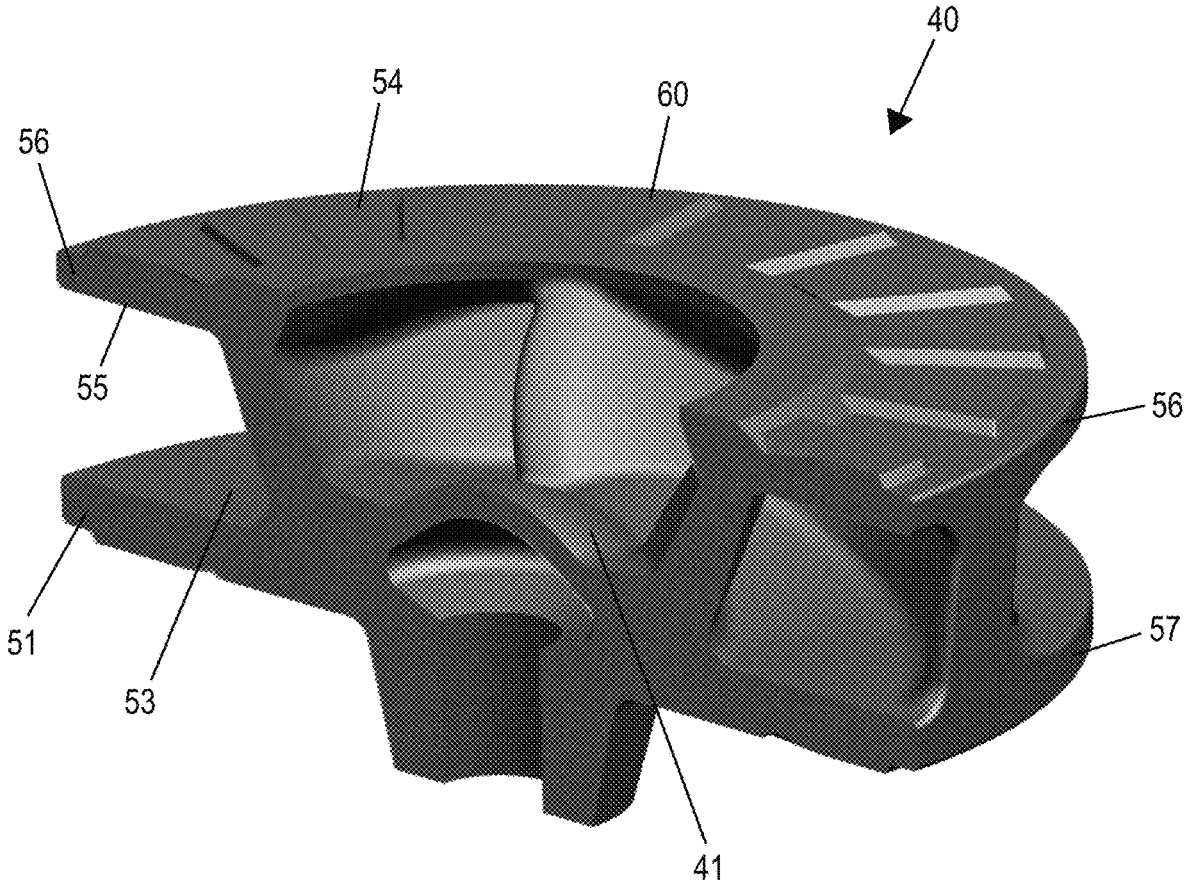
FIG. 10 is a cross-sectional rendered view of an impeller in accordance with an embodiment of the present disclosure.

Referring to FIG. 3 there is shown a cross-section of a known centrifugal slurry pump impeller 40 with the front shroud 50 not shown providing a plan view of the back shroud 51. The impeller 40 includes a back shroud 51 with four pumping vanes 43 extending from the back shroud 51 in a direction generally in line with an axis of rotation X of the slurry pump impeller 40 when in use which provides that the pump impeller 40 turns in a counter clockwise fashion as shown in FIG. 3. The inner face 55 of the back shroud 51 is axisymmetric and also generally in a plane which is at right angles to the axis of rotation X. The four pumping vanes 43 each include a trailing edge 70 and a leading edge 71, where the leading edge 71 of the pumping vanes is adjacent the centre, or nose 47 and inlet 48 of the impeller 40 where the slurry enters during operation of an associated centrifugal slurry pump (not shown). The slurry passes via the inlet 48, towards the nose 47 and then is moved due to the orientation and rotation of the slurry pump impeller through the four passageways 6 located between adjacent pumping vanes 43. The pumping vanes 43 further include opposed main side faces 7, 8. The opposed side faces include a pressure side face 7 also known as a pumping side face, and a suction side face 8. Each of the opposed main side faces 7, 8 define the passageways 6 together with the inner face of the back shroud 53, and the inner face of the front shroud 55 (not shown).

The location and function of the four passageways 6 means that this section of the slurry pump impeller 10 and particularly the area of the passageways 6 along the surfaces of the inner face of the back shroud 53 and the inner face of the front shroud 55 are subjected to significant erosion and wear during the operation of a centrifugal slurry pump impeller 40. Typically during operation there is a higher velocity on the suction side of the pumping vanes 43 adjacent the suction side face 8 and a lower velocity on the pressure, or pumping side face 7, of the pumping vane 43 near the leading edge. This differential in velocity leads to the formation of vortices adjacent the inner faces 53, 52 of the back and front shrouds 51, 50.

Turning to FIGS. 4 to 10 there is shown an embodiment of a centrifugal slurry pump impeller 40 in accordance with the present disclosure. The impeller 40 includes a back shroud 51 and a front shroud 50 each with opposed inner 53, 55 and outer faces 52, 54 and an outer peripheral edge 57, 56 and a central axis. The central axis X is in the location of the center of the nose 47 located on the back shroud 51 and in the center of the inlet of the front shroud 50.

The impeller 40 further includes a plurality of pumping vanes 43 extending between the inner main faces 53, 55 of the back and front shrouds 51, 50. The four pumping vanes 43 are disposed equally spaced from one another around the impeller 40 and include opposed main side faces 7, 8 a leading edge 71 in the region of the central axis X and a trailing edge 70 in the region of the outer peripheral edges 57, 56 of the back and front shrouds 51, 50. The main side faces of the pumping vanes 43 include a pumping or pressure side face 7 and a suction side face 8.

A passageway 6 is located between each adjacent pumping vane 43. Each passageway 6 includes a blended region 110 located between each of the main side faces 7, 8 of the pumping vanes 43 and the inner faces 53, 55 of the front and back shrouds 50, 51. The blended regions act as a transition surface between the surface of the main side faces 7, 8 and the inner faces 53, 55 of the front and back shrouds 50, 51. In addition to the blended regions 110 the surface of the inner face 53, 55 of the front and/or the back shroud 50, 51 includes a raised portion 120 which is located between the blended regions 110 of adjacent pumping vanes 43 in the passageways 6 of the impeller 40.

The raised portion 120 is integrally formed with the surface of the inner face 53, 55 of the front and/or back shroud 50, 51. This provides that the raised portion 120 includes a generally smooth form in shape and is non-obstructive to fluid flow passing through the passageway 6 of the impeller. Otherwise stated, the raised portion 120 does not impede the movement of particles of the slurry moving through the passageway 6 during operation of the pump.

The raised portion 120 is separated from the nose 47 located in the centre of the inner face 53 of the back shroud 51. The nose 47 may be separated by a blended region 110 which acts as a transition surface between the surface of the nose 47 and the surface of the raised portion 120.

The surface of the raised portion 120 defines a region of the inner face 53, 55 of the front and/or back shroud located in the passageways 6 between adjacent pumping vanes 43 The raised portion 120 is spaced from a plane perpendicular to the rotation axis which defines the remainder of the surface in the outer region of the inner face 53, 55 of the front and/or the back shroud 50, 51. The raised portion 120 reduces the distance between the inner faces 53, 55 of the front and/or back shroud in its immediate vicinity. Otherwise stated, the distance between the surface of the raised portion 120 and the other of the inner face 53, 55 of the front and/or back shroud is less that the distance between the inner faces 53, 55 in the outer region of the front and/or the back shroud 50, 51. The raised portion 120, also provides that the inner faces 53, 55 of the front and back shroud are distinct in profile from each other as the raised portion appearing on each of the inner faces 53, 55 of the front and/or back shroud may not be the same in size, shape or location. Furthermore, the raised portion 120 provides that the inner faces 53, 55 of the front and/or back shroud (when considered separately from the plurality of pumping vanes 43) are not axisymmetric in that the raised portion 120 on the inner faces 53, 55 of the front and/or back shroud result in shroud profiles that are asymmetric in a plane that is perpendicular to the rotation axis in contrast to the prior art impellers as exemplified in FIG. 3.

Referring to FIGS. 4 to 9 each passageway 6 of the impeller 40 extends from an inner region 125 of the passageway 6 which starts between two adjacent pumping vanes 43 near their leading edges 71. The passageways 6 continue to an outer region 130 of the passageway wherein the outer region 130 ends at the outer peripheral edge 56, 57 of the front and back shrouds 50, 51. The raised portion 120 may be located in the inner region 125 of the passageway.

Figure 13:
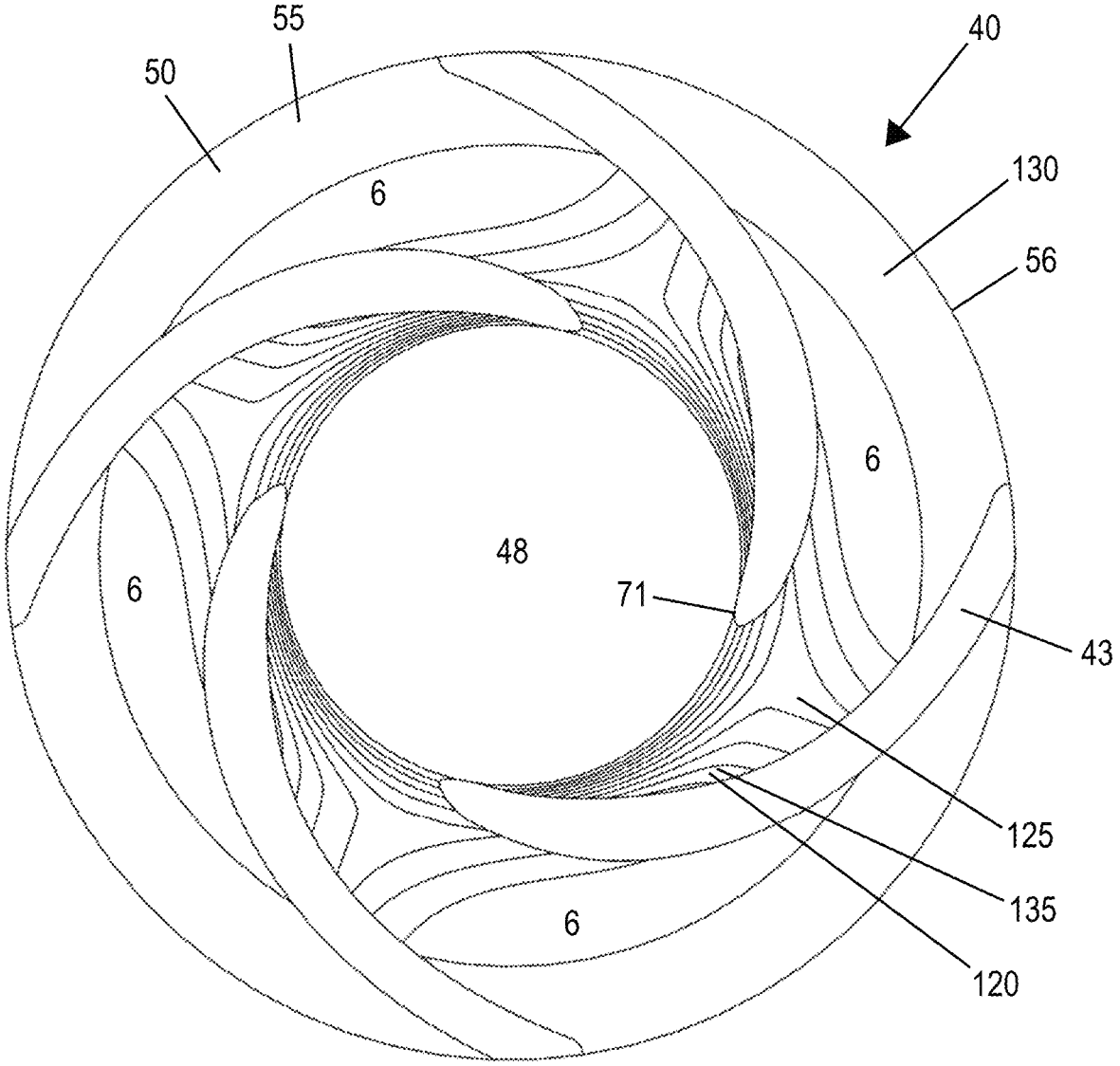
FIG. 13 is a schematic section view of an impeller in accordance with another embodiment of the present disclosure depicting contour lines on the front shroud.
Figure 14:
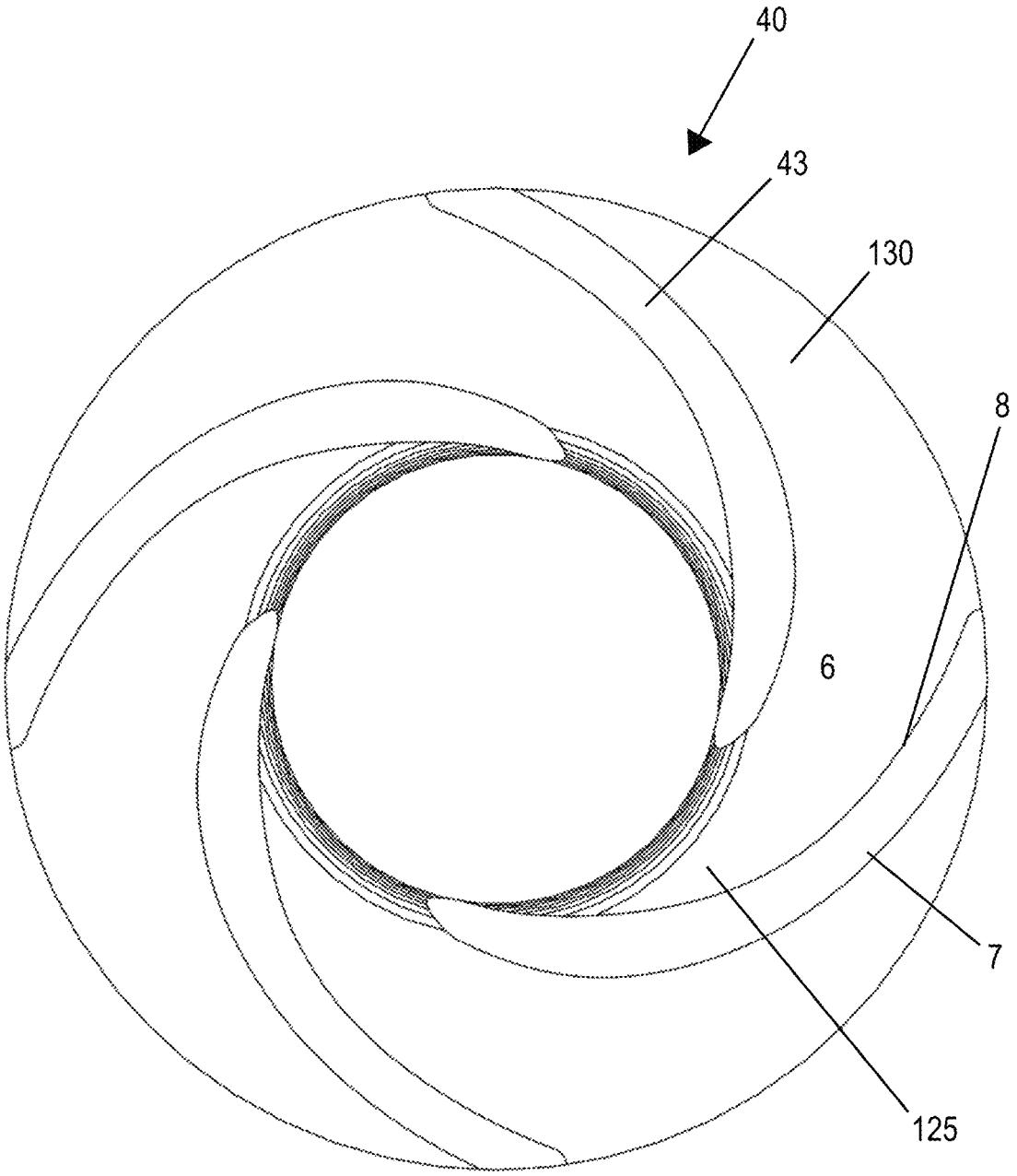
Fig. 14 Prior Art
FIG. 14 is a schematic section view of a prior art impeller depicting contour lines on the front shroud.
Figure 15:
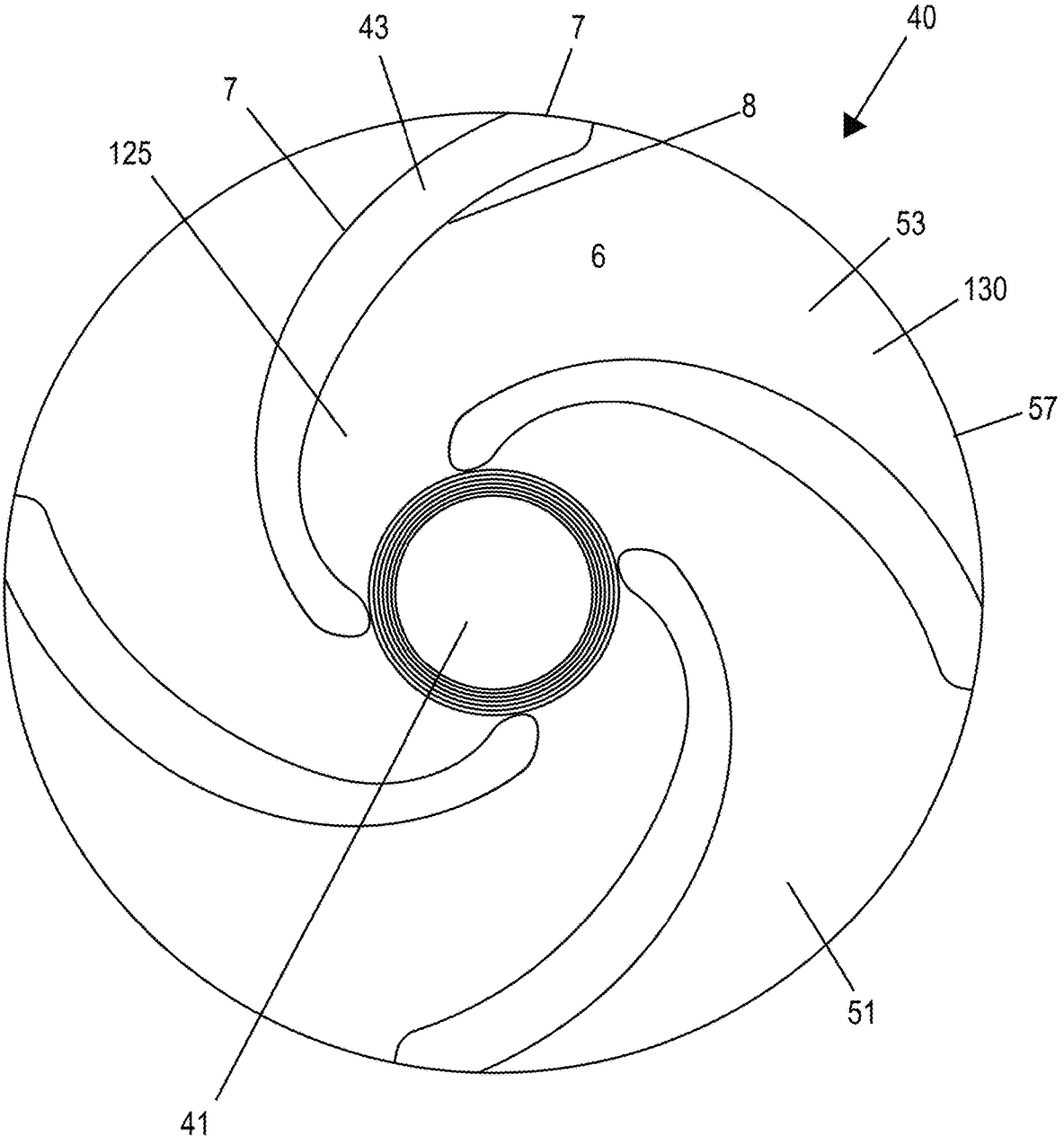
Fig. 15 Prior Art
FIG. 15 is sectional rendered view of the prior art impeller depicted in FIG. 14.

In one embodiment, as shown in the contours outlined on the front shroud depicted in FIG. 13, the inner region 125 of the passageway 6 may end about three quarters along the length of the passageway 6 from the beginning of the passageway 6 adjacent the leading edge 71 of the plurality of pumping vanes 43. Alternatively, the inner region 125 may end about midway along the length of the passageway 6 from the beginning adjacent the leading edge 71 of the plurality of pumping vanes 43 as shown in the embodiment depicted in FIGS. 4 to 9.

In contrast to the inner region 125 of the inner surfaces 53, 55 of the back and front shroud, the outer region 135 of the passageway 6 includes inner surfaces 53, 55 which may be substantially planar and located in a plane that is substantially perpendicular to the central axis.

In certain embodiments, the raised portion 120 may include an apex 135. The apex may be in the form of a convex surface appearing on the inner surfaces 53, 55 of the back and front shrouds 51, 50. The apex 135 of the raised portion 120 provides a surface of the inner face of the back/front shroud 51, 50 which is closest to the inner face of the other of the front/back shroud. The apex 135 may be located closer to the suction side face 8 of the pumping vanes that the pressure side face of the pumping vanes 43 in the passageways 6.

Referring to the impeller depicted in FIGS. 4 to 10, the raised portion 120 provides a surface on the inner faces 53, 55 of the back and/or front shroud 51, 50 which is a continuous raised surface from the blended region 110 associated with one main face of a pumping vane 43 to the blended region 110 of the other main face of an adjacent pumping vane. The raised portion 120 located on the back shroud 51 is separated from the nose 47 located in the centre of the inner face 53 of the back shroud 51. The nose 47 of the impeller is also separated by a blended region 110 which acts as a transition surface between the surface of the nose 47 and the surface of the raised portion 120 appearing on the back shroud 51.

It has been found that locating a raised portion 120 in the inner region 125 of the passageway 6 between the pumping vanes and on the inner faces 53, 55 of the front and/or back shroud 51, 50 the flow of slurry through the passageway when the impeller is in use may be modified to thereby reduce turbulence and inhibit the formation of vortices adjacent the inner main faces 53, 55 of the front and back shrouds 51, 50. By reducing turbulence and inhibiting the formation of vortices, wear in this region of the impeller may be substantially reduced and its commercial working life increased.

Figure 11:
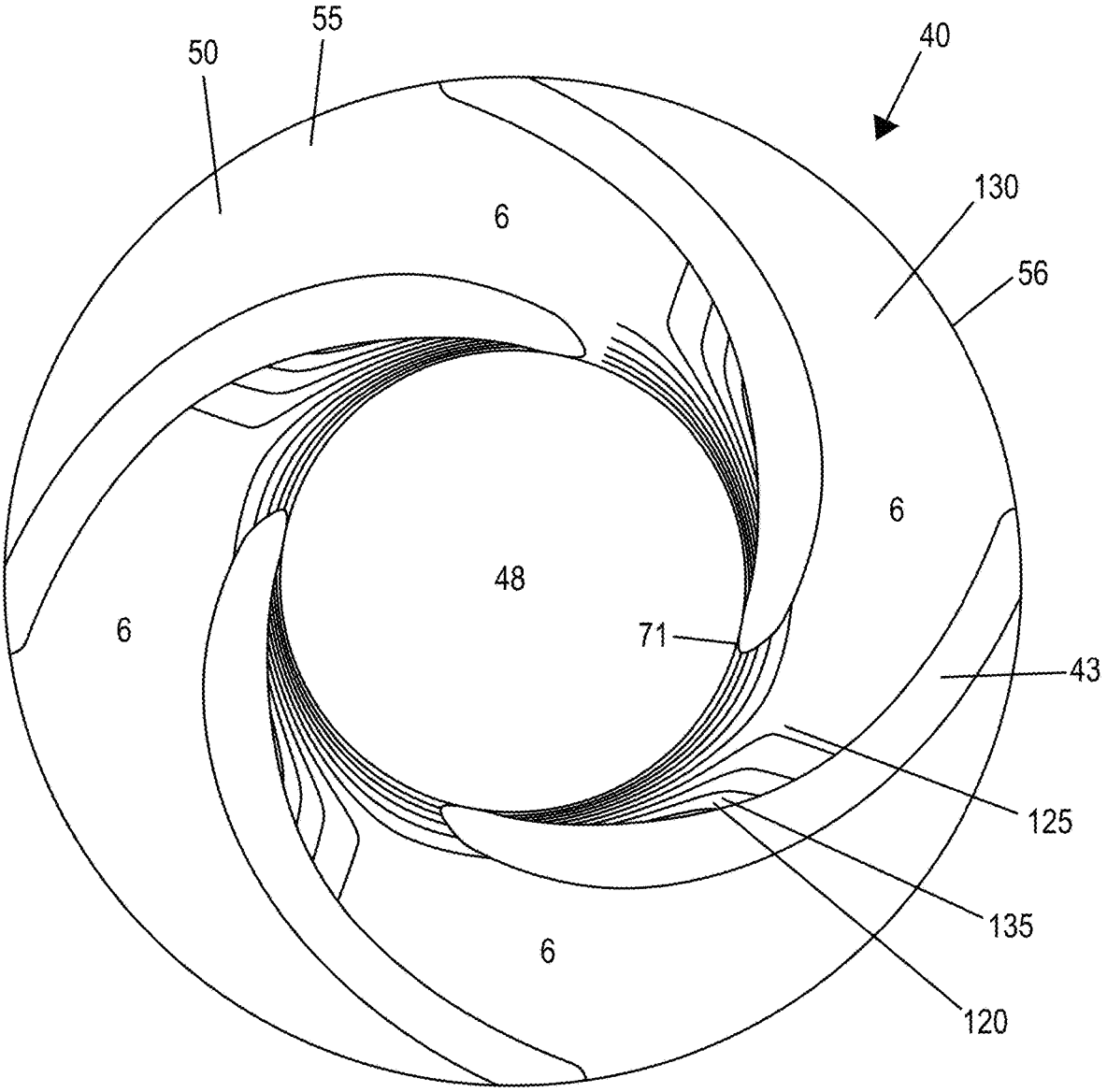
FIG. 11 is a schematic sectional view of the impeller of FIG. 7 depicting contour lines on the front shroud.
Figure 12:
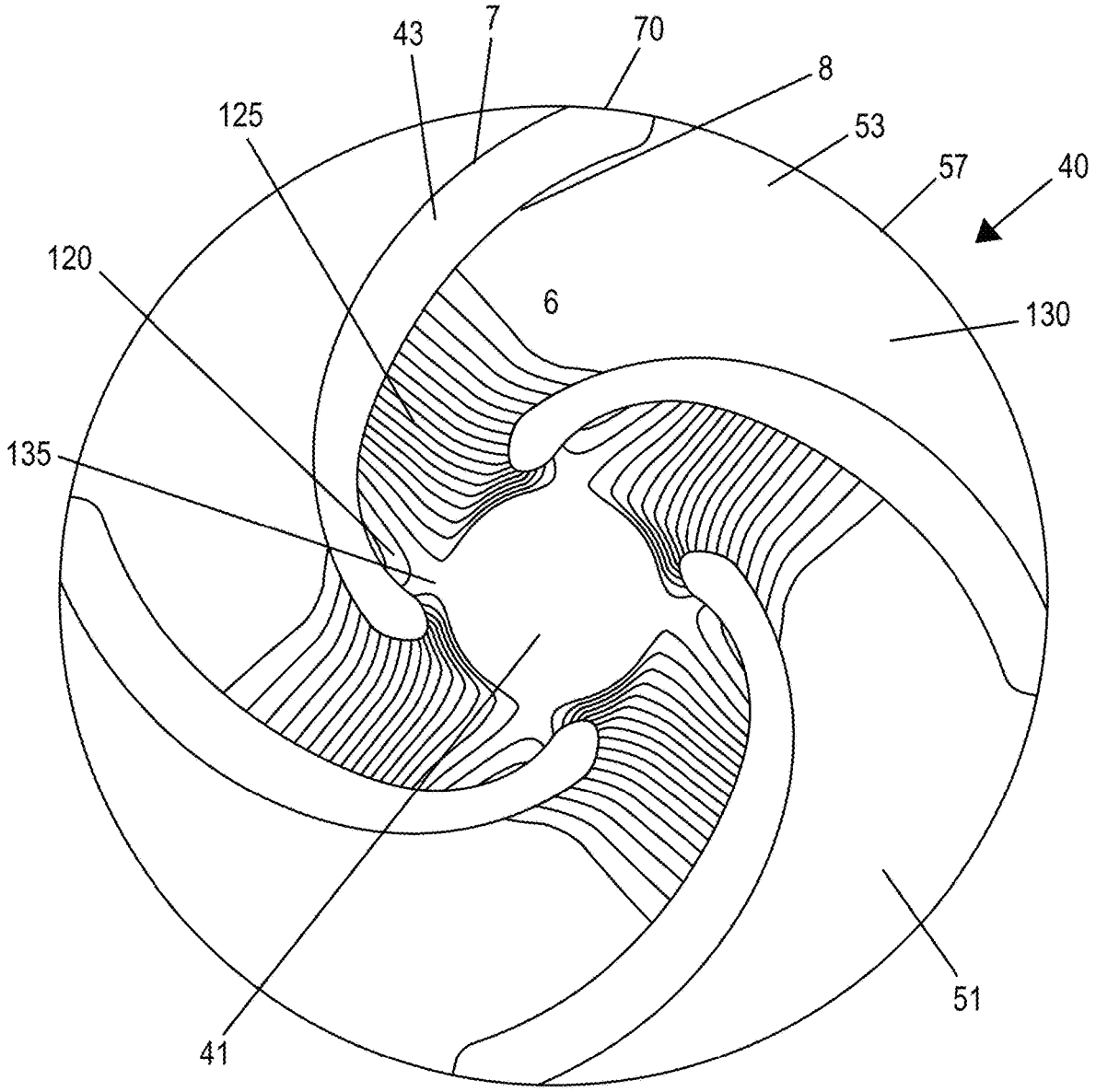
FIG. 12 is a schematic section view of the impeller of FIG. 4 depicting contour lines on the back shroud.

Referring to FIGS. 11 to 13, the schematic views of the front and back shrouds 50, 51 show the surface contours of the raised portion 120 and its apex 135 located in the inner region 125 of the passageways 6. The location of the apex 135 is closer to the suction side face 8 of the pumping vanes than the pressure side face 7.

Referring specifically to FIGS. 11 and 13, the apex 135 of the raised portion 120 may be located on the inner face 55 of the front shroud 50 closer to the suction side face 8 of the pumping vane 43 about ¼ to about ½ of the length of the pumping vane 43 from the leading edge 71, and preferably about ¼ to about ⅓ of the length of the pumping vane 43 from the leading edge 71.

Referring specifically to FIG. 12, the apex 135 of the raised portion 120 may be located on the inner face 53 of the back shroud 51 closer to the suction side 8 of the pumping vane 43 about in line with the leading edge 71 of the pumping vane to about ⅕ of the length of the pumping vane from the leading edge, and preferably about 1/15 to about ⅛ of the length of the pumping vane 43 from the leading edge 71.

In contrast, FIGS. 14 to 20 depict the front and back shrouds 50, 51 respectively of the same prior art impeller. The concentric contours depicted in FIGS. 14 and 15 clearly show the surface of the inner faces 53, 55 of the front and back shrouds 50, 51 are axisymmetric, or substantially flat or planar and located in a plane that is perpendicular to the rotation axis.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

LIST OF PARTS

Pump Apparatus 200
Pump 10
Pedestal 112
Outer casing 22
Side casing parts 23, 24
Inlet 28
Discharge outlet 29
Inner liner 11
Main liner 12
Rear side liner 14
Front side liner 30
Pumping chamber 42
Bolts 27
Seal chamber housing 114
Seal space 118
Drive shaft 116
Stuffing box 117
Passageways 6
Pressure side face 7
Suction side face 8
Top surface 9
Impeller 40
Front shroud 50
Back shroud 51
Pumping vanes 43
Trailing edge 70
Leading edge 71
Inner face of front shroud 55
Outer face of front shroud 54
Peripheral edge portion of front shroud 56
Inner face of back shroud 53
Outer face of back shroud 52
Peripheral edge portion of back shroud 57
Hub 41
Impeller nose 47
Impeller inlet 48
Passage 33

Auxiliary vanes 60, 61
Blended region 110
Raised portion 120
Inner region of passageway 125
Outer region of passageway 130
Apex of the raised portion 135

The invention claimed is:

1. A centrifugal slurry pump impeller including a back shroud and a front shroud each with opposed inner and outer faces and an outer peripheral edge and a central axis, the front shroud including an impeller inlet and the back shroud including an impeller nose raised from the inner face of the back shroud facing the impeller inlet and in line with the central axis, a plurality of pumping vanes extending between the inner main faces of the back and front shroud, the pumping vanes being disposed in spaced apart relation, each pumping vane including opposed main side faces, a leading edge in the region of the central axis and a trailing edge in the region of the outer peripheral edges of the back and front shrouds with a passageway between adjacent pumping vanes, each passageway including a blended region between each of the main side faces of the pumping vanes and the inner faces of the front and back shrouds wherein a surface of the inner face of at least one of the front and back shrouds includes a raised portion located between the blended regions of adjacent pumping vanes and wherein the raised portion is separated from the impeller nose.

2. The centrifugal slurry pump impeller according to claim 1 wherein each passageway extends from an inner region of the passageway beginning adjacent the leading edge of the plurality of pumping vanes to an outer region of the passageway wherein the outer region ends at the outer peripheral edge of the front and back shrouds and wherein the raised portion is located in the inner region of the passageway.

3. The centrifugal slurry pump impeller according to claim 2 wherein the distance between the inner faces of the back and front shroud is greater in the outer region than the inner region of the passageway.

4. The centrifugal slurry pump impeller according to claim 1 wherein the raised portion extends from the inner region adjacent the leading edge of the plurality of pumping vanes and ends about three quarters along the length of the passageway.

5. The centrifugal slurry pump impeller according to claim 1 wherein the raised portion extends from the inner region adjacent the leading edge of the plurality of pumping vanes and ends about midway along the length of the passageway.

6. The centrifugal slurry pump impeller according to claim 1 wherein the inner surfaces of the front and back shroud in the outer region are substantially planar and are in a plane that is substantially perpendicular to the central axis.

7. The centrifugal slurry pump impeller according to claim 1 wherein one of the opposed side faces of the adjacent pumping vanes is a pressure side face and the other of the opposed side faces is a suction side face wherein an apex of the raised portion is located closer to the suction side face than the pressure side face.

8. The centrifugal slurry pump impeller according to claim 7 wherein the apex of the raised portion is located adjacent the suction side face to which it is closest so as to modify the flow of slurry through the passageway in use and thereby reduce turbulence and/or inhibit the formation of vortices formed adjacent the inner main face of the back and/or front shroud.

9. The centrifugal slurry pump impeller according to claim 7 wherein the apex of the raised portion is spaced from the blended region located between the main side faces of the pumping vanes and the inner face of the back and/or front shroud.

10. The centrifugal slurry pump impeller according to claim 1 wherein the raised portion includes a convex surface.

11. The centrifugal slurry pump impeller according to claim 1 wherein the raised portion provides a surface on the inner face of the back and/or front shroud which continues from the blended region associated with one of the opposed side faces to the blended region of the other of the opposed side faces of the adjacent pumping vanes.

12. The centrifugal slurry pump impeller according to claim 1 wherein the raised portion is located on the inner face of the front shroud.

13. The centrifugal slurry pump impeller according to claim 1 wherein the raised portion is located on the inner face of the back shroud.

14. The centrifugal slurry pump impeller according to claim 1 wherein the raised portion is located in each one of the passageways located between adjacent pumping vanes.

15. The centrifugal slurry pump impeller according to claim 1 wherein the pumping vanes are backwardly swept in shape.

16. The centrifugal slurry pump impeller according to claim 1 wherein the impeller has no more than six pumping vanes.

17. The centrifugal slurry pump impeller according to to claim 1 wherein the impeller has four pumping vanes.

18. A centrifugal slurry pump impeller including a back shroud with an inner and outer face and an outer peripheral edge and a central axis, the back shroud including an impeller nose raised from the inner face in line with the central axis, a plurality of pumping vanes extending between the inner main face of the back shroud, the pumping vanes being disposed in spaced apart relation, each pumping vane including opposed main side faces, a leading edge in the region of the central axis and a trailing edge in the region of the outer peripheral edge of the back shroud with a passageway between adjacent pumping vanes, each passageway including a blended region between each of the main side faces of the pumping vanes and the inner face of the back shroud wherein a surface of the inner face of the back shroud includes a raised portion located between the blended regions of adjacent pumping vanes and wherein the raised portion is separated from the impeller nose.

* * * * *